US005735305A

United States Patent [19]

Ikei et al.

[11] Patent Number: 5,735,305

[45] Date of Patent: Apr. 7, 1998

[54] UNLOADING SYSTEM FOR HYDRAULIC CIRCUIT

[75] Inventors: Kazunori Ikei; Keisuke Taka, both of Tochigi-ken, Japan

[73] Assignee: Komatsu Ltd., Tokyo, Japan

[21] Appl. No.: 663,193

[22] PCT Filed: Dec. 21, 1994

[86] PCT No.: PCT/JP94/02175

§ 371 Date: Jun. 11, 1996

§ 102(e) Date: Jun. 11, 1996

[87] PCT Pub. No.: WO95/17609

PCT Pub. Date: Jun. 29, 1995

[30] Foreign Application Priority Data

Dec. 22, 1993 [JP] Japan ..... 5-323644

[51] Int. Cl.[6] ..... F15B 13/08

[52] U.S. Cl. ..... 137/115.23; 91/451; 137/596.13

[58] Field of Search ..... 91/451; 137/115.07, 137/115.19, 115.23, 596.13

[56] References Cited

U.S. PATENT DOCUMENTS

| | | | |
|---|---|---|---|
| 2,781,049 | 2/1957 | Binford et al. | 137/115.07 |
| 3,722,543 | 3/1973 | Tennis | 137/596.13 X |
| 4,040,438 | 8/1977 | Wilke | 137/596.13 X |
| 4,139,021 | 2/1979 | Ailshie et al. | 137/596.13 |
| 4,216,797 | 8/1980 | Budzich | 137/596.13 |

*Primary Examiner*—Gerald A. Michalsky
*Attorney, Agent, or Firm*—Wenderoth, Lind & Ponack

[57] ABSTRACT

An unloading system including an unload valve draining a part of supplied pressurized fluid to a tank and a switching valve for draining a pressurized fluid for biasing the unload valve in a direction for reducing a flow rate of the fluid supplied to the tank. The unload valve and the switching valve are arranged in series in axial direction in a valve main body.

2 Claims, 2 Drawing Sheets

UNLOADING SYSTEM FOR HYDRAULIC CIRCUIT

FIELD OF THE INVENTION

The present invention relates to an unloading system to be employed in a hydraulic circuit for supplying a discharged pressurized fluid of a hydraulic pump to an actuator by a direction control valve.

BACKGROUND ART

In a hydraulic circuit employing a closed center type direction control valve which is designed for closing an inlet port at a neutral position, flow of a discharged pressurized fluid of the hydraulic pump is shut off in the direction control valve to elevate the discharge pressure. As a result, power loss of a driving power source for driving the hydraulic pump becomes large.

Therefore, as a system for reducing the power loss, an unloading system shown in Japanese Examined Patent Publication (Kokoku) No. Heisei 2-53641 has been known, for example.

Namely, it has been known that an unloading system which comprises an unload valve including a pressure receiving portion and a valve portion varying an opening area depending upon variation of the pressure at the pressure receiving portion, and a switching valve, is provided. The switching valve is opened while the direction control valve is held in the neutral position, for establishing fluid communication between a discharge passage of the hydraulic pump and a tank. The switching valve is closed upon switching of the valve position of the direction control valve from the neutral position to the supply position. In conjunction therewith, the opening area of the valve portion is varied by a load pressure acting on the pressure receiving portion of the unload valve to branch a part of the discharged pressurized fluid of the hydraulic pump to the tank to make a pressure difference at the upstream and downstream of the direction control valve constant.

Such unload system encounters a problem in complicated construction since the unload valve constituted of the pressure receiving portion and the valve portion and the switching valve are separated.

The present invention is to overcome such defect in the prior art. Therefore, it is an object of the present invention to provide an unload system for a hydraulic circuit which can significantly simplify the construction.

DISCLOSURE OF THE INVENTION

In order to accomplish the above-mentioned object, according to one aspect of the invention, there is provided an unloading system which is characterized in that an unload valve draining a part of supplied pressurized fluid to a tank and a switching valve for draining a pressurized fluid for biasing the unload valve in a direction for reducing a flow rate for draining to the tank, are arranged in series in an axial direction in a valve main body.

With the construction set forth above, since the unload valve and the switching valve are arranged in axial direction of the valve main body, the construction can be significantly simplified.

It should be noted that, in the construction set forth above, it is desirable that the unload valve is constructed by forming a valve bore having an inlet port, a tank port and an outlet port in the main valve body, fitting a valve body for communicating the inlet port, the tank port and the outlet port, and for increasing and decreasing open area between the inlet port and the tank port, in one side of the valve bore, and forming a first pressure receiving chamber communicated with the inlet port, in which a pressure biases the valve body in a direction for reducing the open area, in the valve bore, and the switching valve is constructed by engaging a spool at the other side of the valve bore for defining a second pressure receiving chamber to be supplied a load pressure between the spool and the valve body, and providing a spring for biasing the spool in a direction for communicating the first pressure receiving chamber to the tank against the load pressure of the second pressure receiving chamber.

Furthermore, it is preferred that the first pressure receiving chamber is defined between the valve body, a valve main body and the plug and the second pressure receiving chamber is defined between the valve body, the plug and the spool, by engaging and fixing a plug to the other side of the valve bore, engaging a small diameter portion of the valve body at one side of an axial bore of the plug, and engaging the spool to the other side of the axial bore, the first pressure receiving chamber is communicated with the inlet port via a cut-out of the valve body, a first fluid bore communicated with the tank and a second fluid bore communicated with the first pressure receiving chamber are formed in the plug, and a communication between the first and second fluid bores is established and blocked by the spool.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of an unloading system according to the present invention will be discussed hereinafter with reference to the accompanying drawings.

Figure 1:
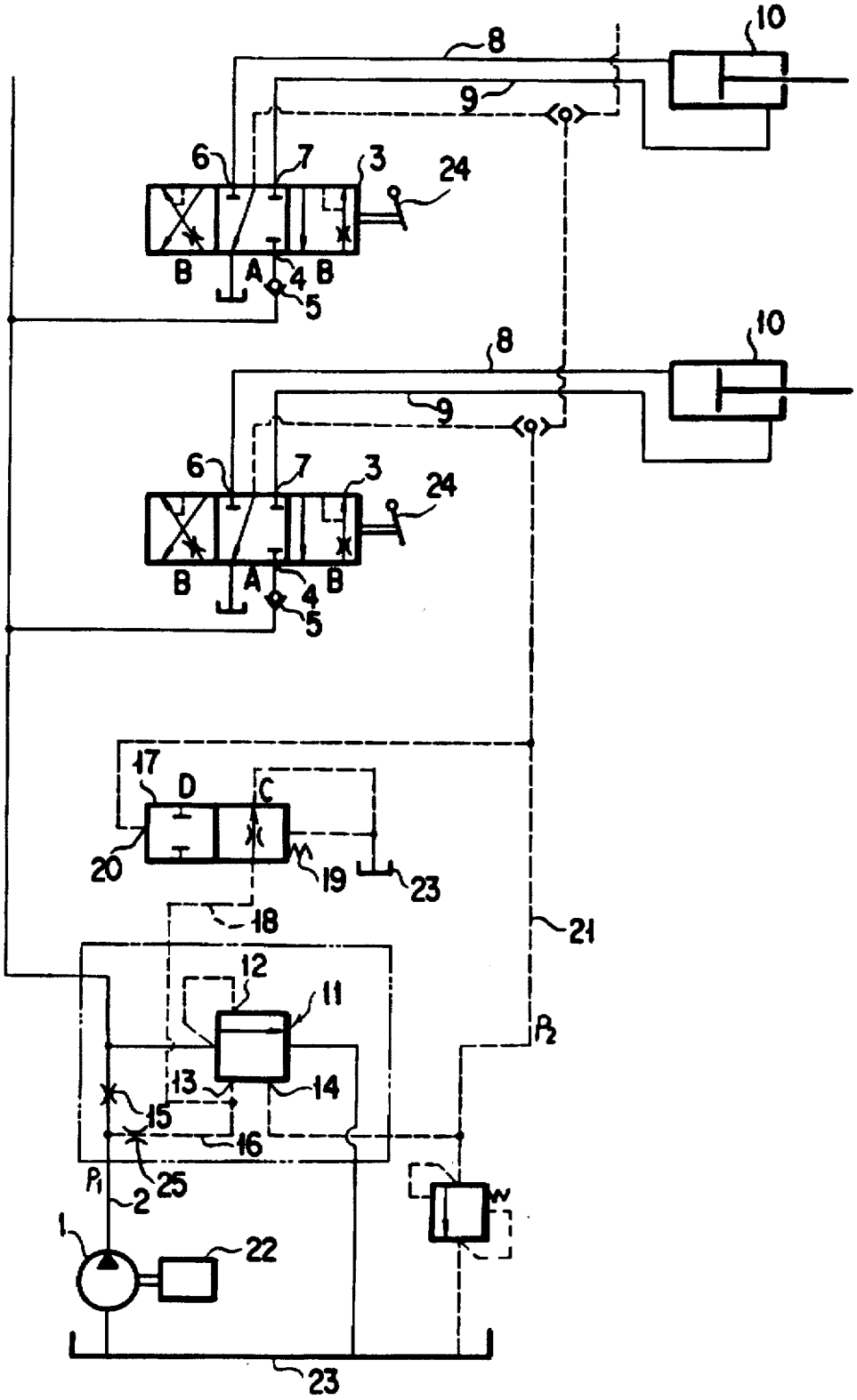
FIG. 1 is an illustration showing a hydraulic circuit having one embodiment of an unloading system according to the present invention.

FIG. 1 is an illustration showing a hydraulic circuit having one embodiment of an unloading system according to the present invention. In the illustrated hydraulic circuit, a discharge passage 2 of a hydraulic pump 1 is connected to an inlet port 4 of a direction control valve 3 via a check valve 5. First and second actuator ports 6 and 7 of the direction control valve 3 are connected to an actuator 10 via first and second circuits 8 and 9, respectively. An unload valve 11 is provided in the discharge passage 2.

A valve body of the unload valve 11 is biased in a direction to increase an open area by a pressure to be applied to a first pressure receiving portion 12 and in a direction to reduce the open area by pressures respectively applied to second and third pressure receiving portions 13 and 14.

An orifice 15 is provided at a position at the side of the hydraulic pump 1 relative to the unload valve 11 in the discharge passage 2. The pressure at the upstream side of the orifice 15 is introduced into the second pressure receiving portion 13 of the unload valve 11 via a circuit 16. On the other hand, the pressure at the downstream side of the orifice 15 is introduced into the first pressure receiving portion 12. Thus, the open area of the unload valve 11 may be increased or decreased depending upon the pressure difference between upstream and downstream of the orifice 15. Also, the second pressure receiving portion 13 of the unload valve 11 is connected to a tank 23 via a circuit 18 including a switching valve 17. A valve body of the switching valve 17 is maintained at a communicating position C by means of a spring 19, and is adapted to be switched into a shut-off position D by a load pressure $P_2$ exerted on a pressure receiving portion 20.

The third pressure receiving portion 14 and the pressure receiving portion 20 are connected to a load detection circuit 21.

Next, the operation of the foregoing embodiment will be discussed.

When the valve body of the direction control valve 3 is placed at a pressurized fluid supply position B, the load pressure $P_2$ is generated in the load pressure detecting circuit 21 to place the valve body of the switching valve 17 at the shut-off position D. Thus, a discharge pressure $P_1$ is supplied to the second pressure receiving portion 13 of the unload valve 11. Then, when a revolution speed of the engine 22 becomes higher to increase a discharge amount of the hydraulic pump 1 per unit period, the pressure difference between upstream side and downstream side of the orifice 15 is increased. Thus, the valve body of the unload valve 11 is biased in the direction for decreasing the open area so as to reduce the fluid amount to recirculate to the tank 23 to increase the supply fluid amount to the actuator 10. Also, the pressure difference between the discharge pressure $P_1$ and the load pressure $P_2$ is increased.

On the other hand, the revolution speed of the engine 22 is lowered to decrease the discharge amount per unit period and the pressure difference between upstream and downstream sides of the orifice 15 is reduced. Therefore, the valve body of the unload valve 11 is biased in the direction for increasing the open area to increase the fluid amount recirculated to the tank 23 and thus to reduce the fluid amount to be supplied to the actuator 10. Thus the pressure difference between the discharge pressure $P_1$ and the load pressure $P_2$ becomes smaller.

Thus, a supply fluid amount to the actuator depending upon the engine revolution speed can be obtained.

On the other hand, by varying the resistance value of flow restriction of the orifice 15 or the pressure receiving area of the pressure receiving portion of the unload valve 11, the rated value of a set pressure difference of the unload valve can be varied.

On the other hand, when the valve body of the direction control valve 3 is operated from the pressurized fluid supply position B to the neutral position A, the pressure of the load pressure detecting circuit 21 becomes zero to place the valve body of the switching valve 17 at a drain position C. Therefore, the discharge pressure $P_1$ to be supplied to the second pressure receiving portion 13 of the unload valve 11 flows to the tank 23. As a result, the valve body of the unload valve 11 is biased in the opening direction to be fully opened. Therefore, the discharge pressure $P_1$ becomes the pressure difference to be caused in the fixed orifice in the unload valve 11. Thus, the power loss of the engine 22 at the neutral position A of the direction control valve 3 can be reduced.

It should be noted that the orifice 25 is provided in the circuit 16 so that pressure is generated in the discharge passage 2 when the circuit 16 is connected to the tank 23.

Next, the concrete construction of the unloading system constituted of the unload valve 11 and the switching valve 17 set forth above will be discussed with reference to FIG. 2.

In the shown unloading system, at one side of a valve bore 31 of a valve main body 30, a valve body 34 for establishing and blocking a communication between an inlet port 32, a tank port 33 and an outlet port 53 is engaged. On the valve body 34, an axial bore 35, a first port 36 and a second port 37 are formed. The inlet port 32 and the axial bore 35 are in communication via the first port 36. In conjunction therewith, the opening area between the tank port 33 and the second port 37 is increased and decreased depending upon the sliding position of the valve body 34. These form the unload valve 11.

At the other side of the bore 31, a plug 38 is inserted and fixed. A small diameter portion 40 of the valve body 34 of the unload valve 11 is engaged in one side of an axial bore 39 of the plug 38. Also, at the other side of the axial bore 39, a spool 41 forming the switching valve 17 is engaged so as to define a pressure receiving chamber 42 between the small diameter portion 40 and the spool 41. The pressure receiving chamber 42 communicates with a load pressure detecting portion 44 via a conduit 43. The pressure receiving chamber 42 is the pressure receiving portion 20 communicated with the third pressure receiving portion 14.

In the spool 41, a small diameter portion 47 a small diameter portion is provided for establishing and blocking communication between a first fluid bore 45 and a second fluid bore 46. The spool 41 is biased in a direction for establishing communication by means of a spring 48 (spring 19 in FIG. 1) and in a direction for blocking communication by the pressure in the pressure receiving chamber 42.

The first fluid bore 45 communicates with the tank 23. The second fluid bore 46 communicates with a pressure receiving chamber 49 defined between the valve body 34 and the plug 38. The pressure receiving chamber 49 communicates with the inlet port 32 via a cut-out 50 of the valve body 34. The cut-out 50 and the second fluid bore 46 are the circuits 16 and 18 in FIG. 1, respectively. Also, the chamber 49 is the first pressure receiving portion 13, in FIG. 1. Also, the cut-out 50 is the orifice 25 in FIG. 1. On the other hand, the axial bore 35 is the second pressure receiving portion 12. Reference numeral 53 denotes an outlet port connected to the inlet port 4 of the direction control valve 3.

As set forth above, the unload valve 11 and the switching valve 17 are arranged in series in the axial direction of the valve main body 30.

Figure 2:
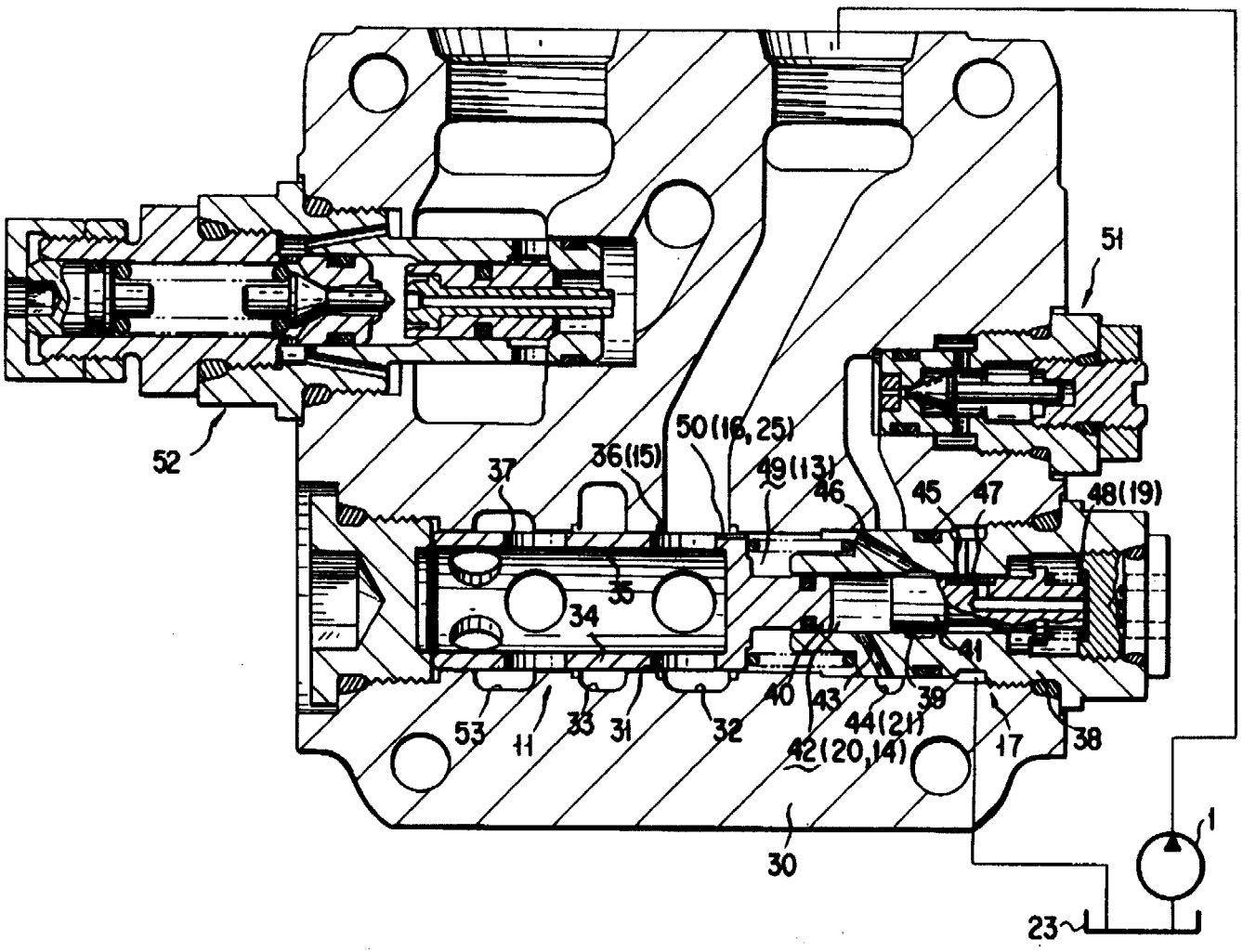
FIG. 2 is a section of the above-mentioned embodiment.

It should be noted that, in FIG. 2, reference numeral 51 denotes a relief valve connected to the load detection port 44 and 52 denotes a safety valve.

Next, the operation of the disclosed embodiment will be discussed.

At first, when the direction control valve 3 is held in the neutral position A, the load pressure is not supplied to the load detecting port 44. Thus, the spool 41 is biased toward the left as viewed in FIG. 2 by the spring 48 to establish communication between the second fluid bore 46 and the first fluid bore 45 via the small diameter portion 47. Therefore, the pressure of the pressure receiving chamber 49 is lowered to reduce the force required to bias the valve body 34 toward left side as shown in the figure.

The valve body 34 slides toward right (in unload direction) due to the pressure in the axial bore 35 to increase an open area between the second port 37 and the tank port 33 so as to lower the discharge pressure of the hydraulic pump 1 to a pressure level greater than the pressure of the tank port 33 in the extent corresponding to the pressure difference caused in the first port 36 of the valve body 34 (the orifice 15 in FIG. 1).

Next, when the direction control valve 3 is switched from the neutral position A to the supply position B, the load pressure is supplied to the load pressure detecting port 44, the spool 41 is biased toward right by the load pressure in the pressure receiving chamber 42 against the spring 48 to block the communication between the first fluid bore 45 and the second fluid bore 46. Thus, by the discharge pressure supplied to the pressure receiving chamber 49, the force biasing the valve body 34 toward the left (in on-load direction) becomes greater.

By this, the valve body 34 slides toward left (in on-load direction) to reduce the open area between the second port 37 and the tank port 33. Thus, the discharge pressure of the hydraulic pump 1 is elevated.

The unload system according to the present invention, operation of which has been discussed above, can simplify the construction thereof since the unload valve 11 and the switching valve 17 are arranged in series in the valve main body 30.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set forth above but to include all possible embodiments which fall within a scope encompassed and equivalents thereof with respect to the feature set out in the appended claims.

What is claimed is:

1. An unloading system comprising:

a valve main body;

an unload valve, for draining a part of supplied pressurized fluid to a tank, said unload valve being defined by a valve bore formed in said valve main body and a valve body, said valve bore having an inlet port, a tank port and an outlet port, said valve body being fitted in one side of said valve bore for communicating with the inlet port, the tank port and the outlet port, and for increasing and decreasing an open area between said inlet port and said tank port, and for forming a first pressure receiving chamber in communication with said inlet port, such that a pressure biases said valve body in a direction of said valve bore for reducing the open area; and a switching valve, arranged in series with said unloading valve in an axial direction of said valve main body, for draining a pressurized fluid for biasing said unload valve in a direction so as to reduce a flow rate to the tank, said switching valve being defined by a spool inserted in the other side of said valve bore for defining a second pressure receiving chamber to be supplied with a load pressure between said spool and said valve body, and a spring for biasing said spool in a direction so as to establish communication between said first pressure receiving chamber and said tank against the load pressure of said second pressure receiving chamber.

2. An unloading system as set forth in claim 1, wherein said first pressure receiving chamber is defined between said valve body, said valve main body and a plug engaged and fixed to the other side of said bore, and said second pressure receiving chamber is defined between said valve body, said plug and said spool, a small diameter portion of said valve body is engaged at one side of an axial bore of said plug, and said spool slidably engaged in the other side of the axial bore of said plug, said first pressure receiving chamber communicates with said inlet port via a cut-out of said valve body, a first fluid bore is formed in said plug so as to provide communication with said tank and a second fluid bore is formed in said plug so as to provide communication with said first pressure receiving chamber, and communication between said first and second fluid bores is established and blocked by said spool.

* * * * *